US009386854B1

(12) United States Patent
Wosoba et al.

(10) Patent No.: US 9,386,854 B1
(45) Date of Patent: Jul. 12, 2016

(54) KNOCK-DOWN BRACKET AND SHELF

(71) Applicant: L&P Property Management Company, South Gate, CA (US)

(72) Inventors: Aaron Wosoba, El Dorado Springs, MO (US); Robert Lloyd Talbot, Neosho, MO (US); Philip Dale Wyatt, Neosho, MO (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 0 days.

(21) Appl. No.: 14/616,086

(22) Filed: Feb. 6, 2015

(51) Int. Cl.
*A47B 96/06* (2006.01)
*A47B 96/02* (2006.01)
*A47B 57/40* (2006.01)

(52) U.S. Cl.
CPC ..... *A47B 96/061* (2013.01); *A47B 57/40* (2013.01); *A47B 96/021* (2013.01); *A47B 96/024* (2013.01)

(58) Field of Classification Search
CPC ... A47F 5/0018; A47F 5/0031; A47F 5/0043; A47F 5/08; A47F 5/101; A47F 5/103; A47F 5/13; A47B 47/021; A47B 47/02
USPC ..... 211/119, 187, 190, 193, 103; 248/235, 248/247; 312/408
See application file for complete search history.

(56) References Cited

U.S. PATENT DOCUMENTS 3,185,426 A * 5/1965 Bjerke ..... A47B 96/061 211/187
4,792,195 A * 12/1988 Adriaansen ..... A47B 88/0407 248/201
4,898,354 A * 2/1990 Whittington ..... A47B 57/585 211/175
4,951,908 A * 8/1990 Kallio ..... A47B 96/061 108/108
5,069,408 A * 12/1991 Bessinger ..... A47B 96/061 108/108
5,538,213 A * 7/1996 Brown ..... A47B 57/42 108/108
6,024,333 A * 2/2000 Raasch ..... A47B 55/02 211/134
6,082,690 A * 7/2000 Durin ..... H02G 3/263 211/90.01
6,123,303 A * 9/2000 Huang ..... A47B 57/482 211/90.02
6,345,795 B1 * 2/2002 Bartz, Jr. ..... A47B 57/42 211/150
6,402,108 B1 * 6/2002 Remmers ..... A47B 57/42 211/181.1
6,464,186 B1 10/2002 Marsh
6,918,498 B2 7/2005 Sparkowski
7,237,856 B2 7/2007 Bienick et al.
7,240,803 B2 * 7/2007 Stitchick ..... A47B 47/022 211/106
7,497,344 B2 * 3/2009 Chen ..... A47B 57/40 108/108
7,540,244 B2 6/2009 Gregory
D596,932 S * 7/2009 Kleinsasser ..... D8/381
D707,067 S * 6/2014 Basarich ..... D6/705
2008/0067909 A1 3/2008 Hanson et al.

* cited by examiner

*Primary Examiner* — Brian Glessner
*Assistant Examiner* — Paola Agudelo
(74) *Attorney, Agent, or Firm* — Michael Best & Friedrich LLP

(57) ABSTRACT

A bracket for a wire-frame shelving unit includes a body extending along a longitudinal axis having a first edge and a second opposing edge and a face extending between the first and second edges. A first flange extends from the first edge orthogonally to the face and includes a first shelf securement member defining a first retention surface. A second flange extends from the second edge orthogonally to the face and includes a second shelf securement member defining a second retention surface. The first retention surface of the first securement member is configured to at least partially surround a first wire of the wire-frame shelving unit and the second retention surface of the second securement member is configured to concurrently at least partially surround a second wire of the wire-frame shelving unit.

20 Claims, 5 Drawing Sheets

KNOCK-DOWN BRACKET AND SHELF

BACKGROUND

The present disclosure relates to a bracket for a shelving unit, and more particularly to a knock-down bracket that requires no additional tools for assembling with a wire-frame shelf.

SUMMARY

A bracket for a wire-frame shelving unit includes a body extending along a longitudinal axis having a first edge and a second opposing edge and a face extending between the first and second edges. A first flange extends from the first edge orthogonally to the face and has a first surface configured for contacting a portion of a wire-frame container. The first flange further includes a first shelf securement member defining a first retention surface. A second flange extends from the second edge orthogonally to the face and has a second surface configured for contacting another portion of the wire frame container. The second flange further includes a second shelf securement member defining a second retention surface. The first retention surface of the first securement member is configured to at least partially surround a first wire of the wire-frame shelving unit and the second retention surface of the second securement member is configured to concurrently at least partially surround a second wire of the wire-frame shelving unit.

A bracket for a shelving unit includes a body extending along a longitudinal axis and including a first edge and a second opposing edge. A first flange extends from the first edge and has a first contact surface and a first shelf securement member that defines a second contact surface configured to at least partially surround a first portion of a shelving unit. A second flange extends from the second edge offset from the first flange along the longitudinal axis. The second flange has a third contact surface and a second shelf securement member defining a fourth contact surface configured to at least partially surround a second portion of the shelving unit. The fourth contact surface faces away from the second contact surface.

A shelving unit includes a first support post and a second support post and a wire-frame shelf member that has a plurality of frame wires and a plurality of support wires. The shelving unit further includes a bracket member configured for coupling the wire-frame shelf member to one of the first or second support posts. The bracket member has a body extending along a longitudinal axis having a first edge and a second opposing edge and a face extending between the first and second edges. A first flange extends from the first edge orthogonally to the face and has a first surface configured for contacting a portion of the wire-frame shelf member. The first flange further includes a first shelf securement member defining a first retention surface. A second flange extends from the second edge orthogonally to the face and has a second surface configured for contacting another portion of the wire-frame shelf member. The second flange further includes a second shelf securement member defining a second retention surface. The first retention surface of the first securement member is configured to at least partially surround a first frame wire of the wire-frame shelf member and the second retention surface of the second securement member is configured to concurrently at least partially surround a second frame wire of the wire-frame shelf member.

Other aspects will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways.

Figure 1:
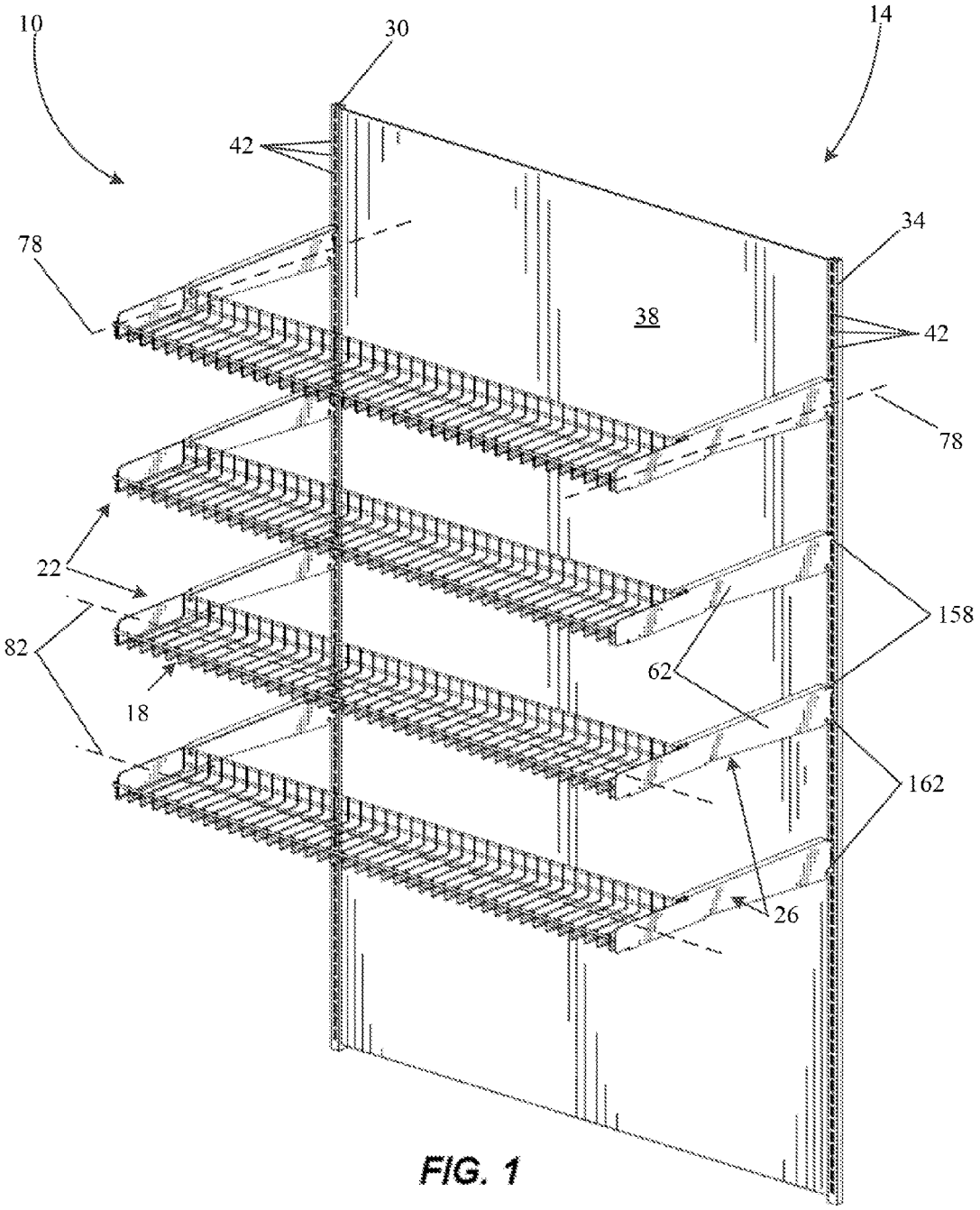
FIG. 1 is a perspective view of a shelving unit.

Referring to FIG. 1, a shelving unit 10 includes a gondola 14 and left and right brackets 22, 26, which cooperate in pairs to support opposite ends of a single container or shelf member 18.

The gondola 14 includes a first vertical support post 30, a second vertical support post 34, a connecting plate or sheet 38, and a base (not shown) for maintaining the gondola 14 in its upright configuration. The connecting sheet 38 extends between the first vertical support post 30 and the second vertical support post 34. Each post 30, 34 includes a plurality of spaced mounting apertures or sockets 42.

Figure 2:
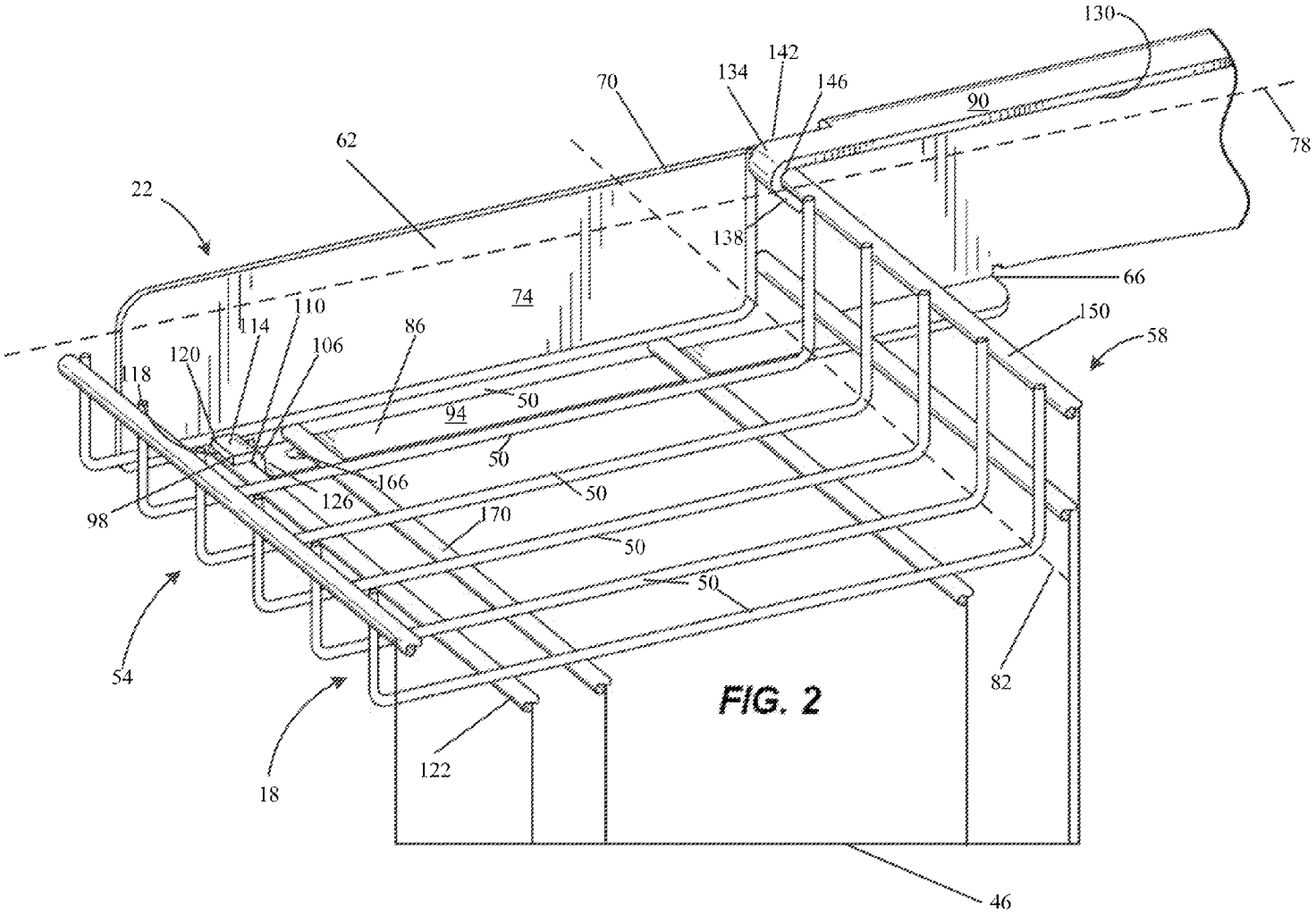
FIG. 2 is a partial perspective view of a bracket and a shelf of the shelving unit of FIG. 1.
Figure 3:
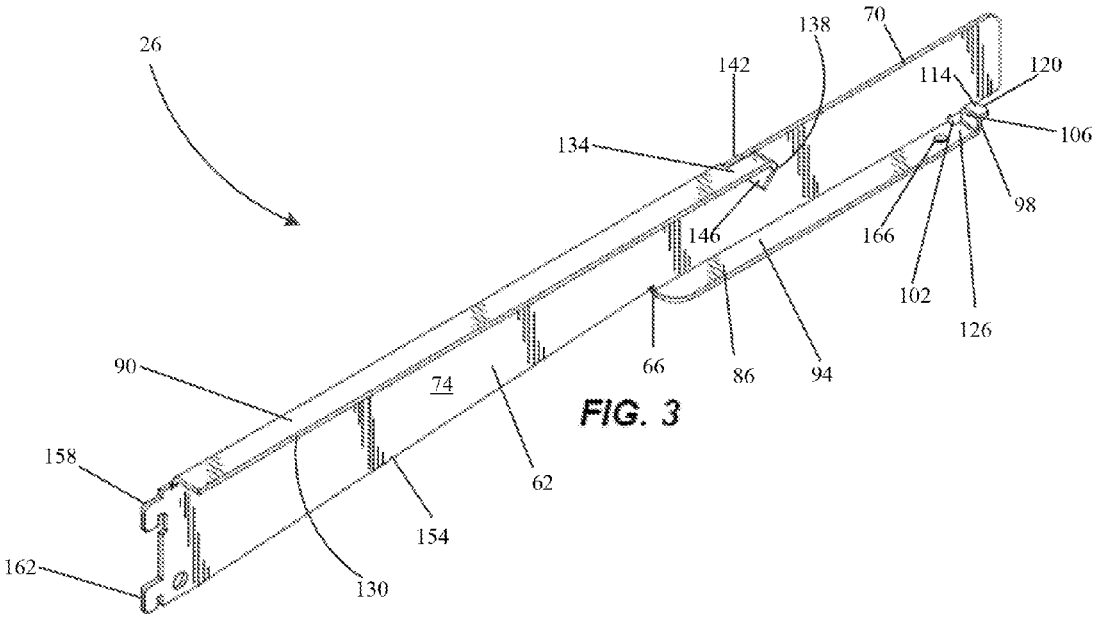
FIG. 3 is a perspective view of a bracket of the shelving unit of FIG. 1.
Figure 4:
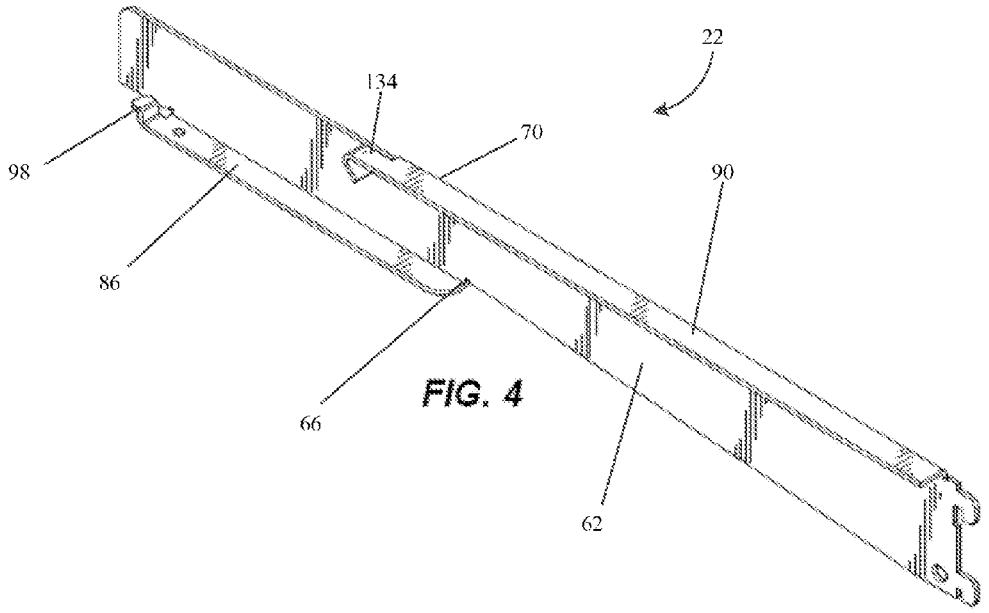
FIG. 4 is another perspective view of the bracket of FIG. 3.

Referring to FIGS. 1 and 2, each shelf 18 includes a plurality of frame wires 46 extending along a shelf axis 82 and a plurality of support wires 50 oriented orthogonally to the frame wires 46. The support wires 50 are fixed to the frame wires 46 by known methods and form a shelf receptacle having a front end 54 and a rear end 58 shaped to hold a number of product containers, e.g., jars, and specifically jars of salsa, cheese, and similar food products. The height of the rear end 58 is generally higher than the height of the front end 54. Though illustrated as a wire-frame shelf member, shelf 18 is not so limited and may encompass various types of shelves and shelving.

Referring to FIGS. 2-6, each of the left and the right brackets 22, 26 includes a body 62 extending generally along a longitudinal axis 78 and having a first edge 66 and a second opposing edge 70 with a bracket face 74 extending therebetween. A first flange 86 and a second flange 90 project from the respective first and second edges 66, 70 orthogonally to the bracket face 74 and generally parallel to the longitudinal axis 78.

The first flange 86 extends from the first edge 66 of the body 62 and presents a support or contact surface 94 having a through hole 166. A first securement member 98, integrally formed as one piece with the first flange 86, is spaced from the body 62 to define a recess 102 therebetween. The first securement member 98 is formed with a first angled or bent portion 106 generally orthogonal to the support surface 94 and defining a first contact or retention surface 110, which is continuous with a second angled or bent portion 114 generally parallel to the support surface 94 and defining a second contact or retention surface 118, and a lip 120. The second portion 114 is thereby offset from the support surface 94. The first securement member 98 is capable of at least partially flexing about a point 126 between the first flange 86 and the first securement member 98. The first and second retention surfaces 110, 118, which can be together considered a retention surface, are configured to retain a first frame wire 122 of the shelf 18, as will be described in further detail below.

The second flange 90 extends from the second edge 70 of the body 62 and is offset along the axis 78 from the first flange 86. The second flange 90 presents a contact surface 130 opposing the support surface 94 of the first flange 86. In the embodiment of FIGS. 2-6, the second flange 90 may extend along a substantial portion of the second edge 70 and may partially overlap with the first flange 86. A second securement member 134 integrally formed as one piece with the second flange 90 and in the form of a grasping portion or hook 138 projects from the second flange 90 and defines a second recess 142 with the body 62. The grasping portion 138 is bent to form an acute angle with reference to the second flange 90 and further defines an inner contact or retention surface 146. The inner retention surface 146, which generally faces in a direction away from the retention surfaces 110, 118, is configured to seat a second frame wire 150 of the shelf 18, as will be described in further detail below. The grasping portion 138 is capable of at least partially bending or flexing clockwise, as viewed in the orientation of FIG. 2, thereby increasing the angle between the second flange 90 and the grasping portion 138.

Figure 5:
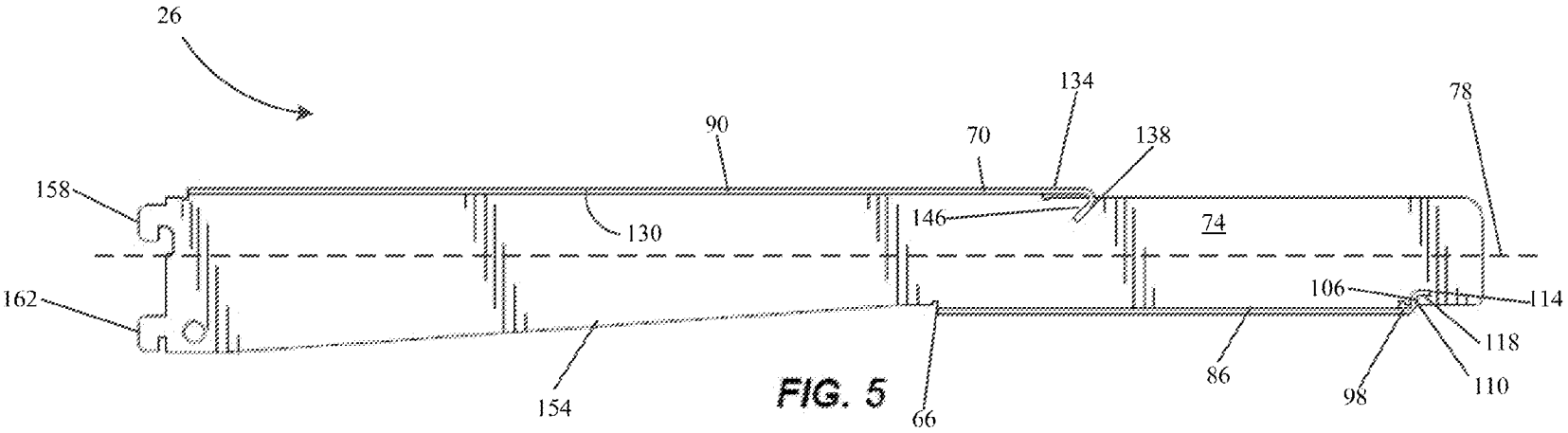
FIG. 5 is a side-view of the bracket of FIG. 3.
Figure 6:
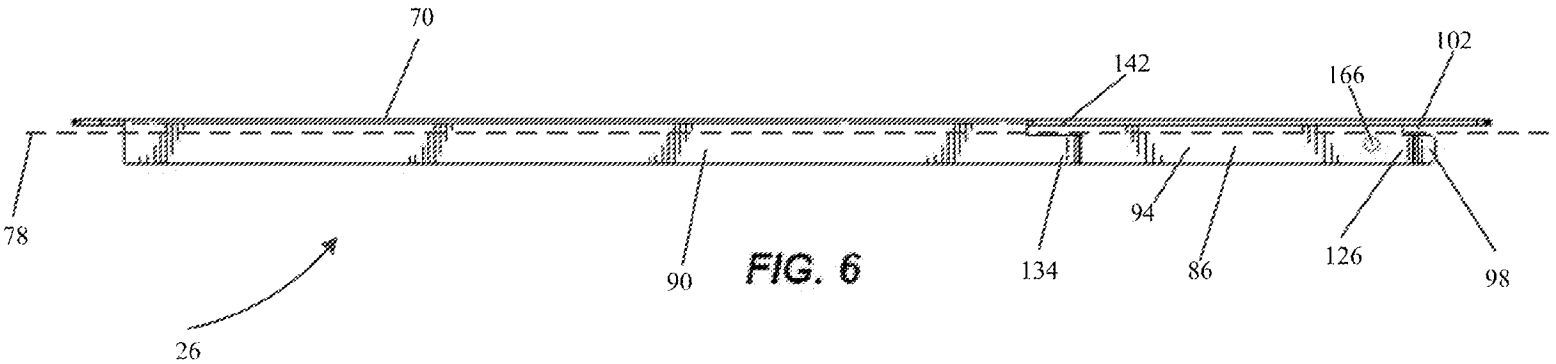
FIG. 6 is a top view of the bracket of FIG. 3.

Each bracket 22, 26 further includes a first catch 158 and a second catch 162 extending from a bracket end. The first catch 158 and the second catch 162 are hook-shaped and spaced from each other such that they can be positioned into the sockets 42. A divergent edge 154 of each bracket 22, 26 deviates from the second edge 70 as it extends toward the bracket end so that the divergent edge 154 is not parallel with the second edge 70. As shown in FIG. 5, the divergent edge provides a broader body at one end of each bracket 22, 26.

In one embodiment, the length of the body 62 of each bracket 22, 26 is about 18 inches, but can range from approximately 10 inches to approximately 24 inches. The length of the first flange 86 is about 9 inches, but can range from approximately 6 inches to approximately 22 inches. The length of the second flange 90 is about 16 inches, but can range from approximately 2 inches to approximately 17 inches. The distance between the first securement member 98 and the second securement member 134 is about 6 inches, but can range from approximately 5 inches to approximately 22 inches.

Referring again to FIGS. 1 and 2, as assembled the shelf 18 extends from the left bracket 22 to the right bracket 26 such that the frame wires 46 are generally perpendicular to the bracket faces 74 of each of the brackets 22, 26, and the shelf axis 82 is generally orthogonal to the longitudinal axis 78. As shown in FIG. 2, one or more frame wires 46 rests upon the support surface 94 of the left bracket 22, a first frame wire 122 is engaged with the first securement member 98, and a second frame wire 150 is engaged with the second securement member 134. Specifically, the first frame wire 122 is positioned against the retention surfaces 110, 118 of the first and second angled portions 106, 114 of the first securement member 98. The second frame wire 150 is positioned in contact with the inner retention surface 146 of the second securement member 134 and can be at least partially in contact with a portion of the contact surface 130. A third frame wire 170 may be positioned adjacent the first frame wire 122. A similar interaction is found between the shelf 18 components and the right bracket 26.

Assembly of the shelving unit 10 to the gondola 14 requires no tools or hardware (e.g., nuts and bolts) and can be accomplished entirely by hand. A user first hangs the left and the right brackets 22, 26 from the gondola 14. Specifically, the first catch 158 and the second catch 162 of each bracket 22, 26 are paired with and inserted into corresponding sockets 42 of the associated vertical support posts 30, 34 at equal heights from the base. The user then concurrently mounts the shelf 18 to the left and the right brackets 22, 26.

At each bracket, the user first orients the end of the shelf 18 with respect to the bracket (22 or 26) to catch the second frame wire 150 behind the grasping portion 138, with the endmost support wire 50 positioned within the second recess 142. The shelf 18 is pulled in a direction away from the gondola 14 until the second frame wire 150 contacts the inner surface 146 of the grasping portion 138. The shelf 18 is then pivoted about the second frame wire 150 (counterclockwise when viewed in the orientation of FIG. 2) until the first frame wire 122 contacts the second portion 114 of the first securement member 98. The shelf 18 is then leveraged away from the gondola 14, slightly flexing the grasping portion 138. Continued rotation of the shelf 18 also forces the first securement member 98 downward, i.e., the first securement member 98 flexes in response to contact between the first frame wire 122 and the second portion 114 of the first securement member 98 until the first frame wire 122 snaps over the lip 120 into its assembled position, which also returns the securement members 98, 134 to the positions shown in FIG. 2. Removal of the brackets 22, 26 and the shelf 18 from the gondola 14 is done in reverse of the process explained above.

In other methods of assembly, the user can, optionally, leverage the first wire 122 of the shelf 18 over the second portion 114 of the first securement member 98 and into its assembled position with the use of a tool, in particular a screwdriver or other relatively long, skinny, and sturdy object. For example, after rotating the first wire 122 to the second portion 114, the user can insert the tool through the through hole 166, positioning a shaft of the tool on the side of the third wire 170 nearest the second flange 90. The tool can then be rotated counterclockwise, as viewed in the orientation of FIG. 2, forcing the shelf away from the gondola, at which point it can be seated with respect to the first securement member 98 as described above.

Other sequences of assembly are also possible. For instance, the shelf 18 may be concurrently attached to the left bracket 22 and the right bracket 26 before the left and the right bracket 26 are hung from the gondola 14. Similarly, the left and the right bracket 22, 26 may be removed from the gondola 14 before the shelf 18 is removed from the left and right bracket 22, 26.

Figure 7:
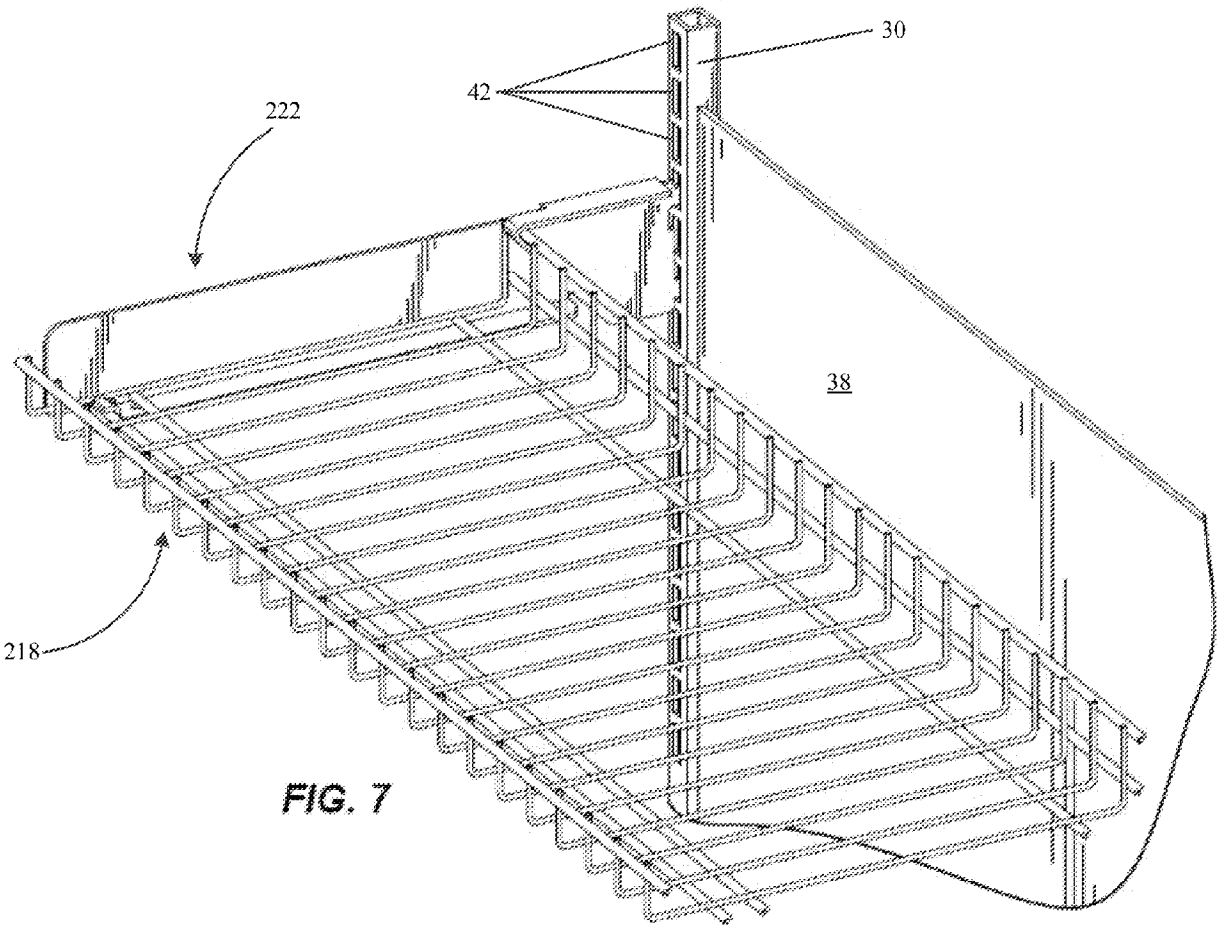
FIG. 7 is another partial perspective view of a bracket and a shelf of another shelving unit.

As noted above, the dimensions of the bracket 22, 26 may vary. For instance, the length and height of the bracket body 62 and/or the first and second flanges 86, 90 can be longer or shorter for pairing with gondolas of different sizes or as part of a standalone shelf, among other reasons. Additionally, the distance between the first securement member 98 and the second securement member 134 can be shorter or longer for pairing with differently sized wire-frame shelves that hold other products or more products. As an example, FIG. 7 illustrates a larger shelf 218 with a bracket 222 that permits increased holding capacity when compared to the assembly of FIGS. 1 and 2. In yet other embodiments, the rear end 58 of the shelf 18, 218 may be higher than previously shown such that when assembled the second securement member 134 engages the lower of two adjacent frame wires 46 at the rear end 58.

In other embodiments, the gondola 14 may include more than two vertical support posts for supporting different sizes of shelves and brackets. In yet other embodiments, the gondola 14 may not include the connecting sheet 38 between the first support post 30 and the second support post 34. Rather, the posts 30, 34 may be independently standing posts, or may be supported by other means known in the art.

Thus, the disclosure provides, among other things, a bracket for a shelving unit requiring no additional tools or hardware for assembly with a wire-frame or similar shelf. While the above describes example embodiments of the present disclosure, these descriptions should not be viewed in a limiting sense. Rather, there are several variations and modifications which may be made without departing from the scope of the present disclosure.

What is claimed is:

1. A bracket for a wire-frame shelving unit, the bracket comprising:

a body extending along a longitudinal axis and including a first edge and a second opposing edge and a face extending between the first and second edges;

a first flange extending from the first edge orthogonally to the face, the first flange having a first surface configured for contacting a portion of a wire-frame shelf, the first flange further including a first shelf securement member defining a first retention surface, wherein the first securement member is flexible about a first axis that is orthogonal to the longitudinal axis; and a second flange extending from the second edge orthogonally to the face, the second flange having a second surface configured for contacting another portion of the wire-frame shelf, the second flange further including a second shelf securement member defining a second retention surface, wherein the second securement member is flexible about a second axis that is orthogonal to the longitudinal axis, wherein the first retention surface of the first securement member is configured to at least partially surround a first wire of the wire-frame shelf and the second retention surface of the second securement member is configured to concurrently at least partially surround a second wire of the wire-frame shelf.

2. The bracket of claim 1, wherein the first retention surface faces away from the second retention surface.

3. The bracket of claim 1, wherein the first flange is offset from the second flange along the longitudinal axis.

4. The bracket of claim 3, wherein the first flange and the second flange at least partially overlap along the longitudinal axis.

5. The bracket of claim 1, wherein the first surface configured for contacting a portion of a wire-frame shelf is parallel to the second surface configured for contacting another portion of the wire-frame shelf.

6. The bracket of claim 1, wherein the first shelf securement member is integrally formed as one piece with the first flange and spaced from the face by a first gap.

7. The bracket of claim 6, wherein the second shelf securement member is integrally formed as one piece with the second flange and spaced from the face by a second gap.

8. The bracket of claim 1, wherein the distance from the first retention surface to the second retention surface along the longitudinal axis is greater than six inches.

9. A bracket for a shelving unit, the bracket comprising:

a body extending along a longitudinal axis and including a first edge and a second opposing edge;

a first flange extending from the first edge and having a first contact surface and a first shelf securement member defining a second contact surface configured to at least partially surround a first portion of the shelving unit and to receive the first portion of the shelving unit from a first direction along the longitudinal axis; and a second flange extending from the second edge offset from the first flange along the longitudinal axis, the second flange having a third contact surface and a second shelf securement member defining a fourth contact surface configured to at least partially surround a second portion of the shelving unit and to receive the second portion of the shelving unit from a second direction along the longitudinal axis, the first direction being different from the second direction.

10. The bracket of claim 9, wherein the shelving unit is a wire-frame shelving unit.

11. The bracket of claim 9, wherein the bracket further comprises a first catch extending from an end of the body generally parallel to the longitudinal axis, the first catch shaped like a hook.

12. The bracket of claim 9, wherein the first flange and the second flange at least partially overlap along the longitudinal axis.

13. The bracket of claim 9, wherein the first contact surface is parallel to the third contact surface.

14. The bracket of claim 13, wherein the second shelf securement member forms an acute angle with the second flange.

15. The bracket of claim 9, wherein the distance between the second surface and the fourth surface is greater than six inches.

16. A shelving unit comprising:

a first support post and a second support post;

a shelf; and a bracket member configured for coupling the shelf to one of the first or second support posts, the bracket member including a body extending along a longitudinal axis and including a first edge and a second opposing edge and a face extending between the first and second edges;

a first flange extending from the first edge orthogonally to the face, the first flange having a first surface configured for contacting a first portion of the shelf, the first flange further including a first shelf securement member defining a first retention surface, wherein the first securement member is flexible about a first axis that is orthogonal to the longitudinal axis; and a second flange extending from the second edge orthogonally to the face, the second flange having a second surface configured for contacting a second portion of the shelf, the second flange further including a second shelf securement member defining a second retention surface, wherein the second securement member is flexible about a second axis that is orthogonal to the longitudinal axis, wherein the first retention surface of the first securement member is configured to at least partially surround the first portion of the shelf and the second retention surface of the second securement member is configured to concurrently at least partially surround the second portion of the shelf.

17. The shelving unit of claim 16, wherein the first retention surface faces away from the second retention surface.

18. The shelving unit of claim 16, wherein the first flange is offset from the second flange along the longitudinal axis.

19. The shelving unit of claim 18, wherein the first flange and the second flange at least partially overlap along the longitudinal axis.

20. The shelving unit of claim 16, wherein the first surface configured for contacting the first portion of the shelf is parallel to the second surface configured for contacting the second portion of the shelf.

* * * * *